US009469932B2

(12) United States Patent
Rocchitelli

(10) Patent No.: US 9,469,932 B2
(45) Date of Patent: Oct. 18, 2016

(54) INTERLOCK MECHANISM FOR THE CLOSING DOOR OF WASHING MACHINES OR TUMBLE DRYERS

(75) Inventors: Onofrio Rocchitelli, Nerviano (IT); Rocchitelli Stefano, legal representative, Nerviano (IT)

(73) Assignee: ELETTROTECNICA ROLD S.R.L., Nerviano (IT)

( * ) Notice: Subject to any disclaimer, the term of this patent is extended or adjusted under 35 U.S.C. 154(b) by 137 days.

(21) Appl. No.: 14/343,971

(22) PCT Filed: Jul. 20, 2011

(86) PCT No.: PCT/IT2011/000256
§ 371 (c)(1),
(2), (4) Date: Mar. 10, 2014

(87) PCT Pub. No.: WO2013/011528
PCT Pub. Date: Jan. 24, 2013

(65) Prior Publication Data

US 2015/0225886 A1 Aug. 13, 2015

(51) Int. Cl.

| | |
|---|---|
| ***B05C 9/10*** | (2006.01) |
| ***D06F 37/42*** | (2006.01) |
| ***D06F 37/28*** | (2006.01) |
| ***E05B 47/00*** | (2006.01) |
| ***E05B 65/00*** | (2006.01) |
| ***E05C 1/08*** | (2006.01) |
| ***E05C 19/00*** | (2006.01) |

(52) U.S. Cl.
CPC ..... *D06F 37/42* (2013.01); *D06F 37/28* (2013.01); *E05B 47/0012* (2013.01); *E05B 65/00* (2013.01); *E05C 1/08* (2013.01); *E05C 19/00* (2013.01); *Y10T 292/0841* (2015.04)

(58) Field of Classification Search
USPC ..... 292/38, DIG. 69
See application file for complete search history.

(56) References Cited

U.S. PATENT DOCUMENTS

| | | | | |
|---|---|---|---|---|
| 4,620,735 | A * | 11/1986 | Heydner | D06F 37/42 200/50.1 |
| 6,082,787 | A * | 7/2000 | Chioffi | D06F 37/42 292/128 |
| 6,634,684 | B2 * | 10/2003 | Spiessl | D06F 7/42 134/57 DL |
| 7,775,070 | B2 * | 8/2010 | Lim | D06F 37/42 68/12.26 |
| 8,727,391 | B2 * | 5/2014 | Berginc | A47L 15/4259 292/144 |

FOREIGN PATENT DOCUMENTS

| | | |
|---|---|---|
| EP | 0347592 A1 | 12/1989 |
| FR | 2930953 A1 | 11/2009 |

* cited by examiner

*Primary Examiner* — Mark Williams
(74) *Attorney, Agent, or Firm* — Jacobson Holman, PLLC

(57) ABSTRACT

In door interlock mechanisms, used for locking the door of washing machines or fumble dryers, the closed or open state of the door of the machine is detected by reading the resistive value of a circuit in which a switch is placed in series. The interlock mechanism according to the invention envisages providing the door interlock with two contacts that make it possible to check, independently, whether the device is in the position with the door closed and locked and whether the door catch is inserted in the device. The device comprises an open-door contact, actuated in the closing position by a shaped portion of a first slider and in the opening position by a shaped portion of a second slider which, under the action of elastic means, interacts with the door catch.

7 Claims, 3 Drawing Sheets

INTERLOCK MECHANISM FOR THE CLOSING DOOR OF WASHING MACHINES OR TUMBLE DRYERS

This is a national stage of PCT/IT11/000256, filed Jul. 20, 2011, hereby incorporated. by reference.

The present invention relates to an interlock mechanism for the closing door of washing machines or tumble dryers.

The drum of washing machines is closed by a door with a hermetic seal, hinged to the front panel of the machine and provided with a closing catch that engages with an interlock mechanism, also mounted on the front panel of the machine.

The interlock mechanism also comprises a mechanism for instantaneous interlocking and delayed release of the door, called the door interlock, which has the function of preventing opening of the door after the machine has been started and of delaying opening thereof at the end of the working cycle, for example to ensure that inside it the inertial rotation of the drum has ceased.

Door interlock mechanisms are known that also perform the function of preventing starting of the machine with the door open by means of a microswitch that closes the machine operating circuit only when the door is closed and interlocked.

Moreover, devices are known which, as well as inhibiting starting of the machine with the door open, also make it possible to interrupt its operating cycle in the case when, during operation of the machine, the door catch accidentally becomes detached from its seating, for example as a result of yielding of the catch or of the striking zone or through incorrect dimensioning thereof.

However, devices of this type have the drawback that they permit starting of the machine with the door open in the case when the mechanical device locking the door catch is actuated in the retaining position, for example using a pointed object that simulates the action of the catch.

Thus, the known devices are unable to recognize and resolve all situations in which operation of the machine takes place incorrectly, i.e. with the door open, with undesirable consequences and contrary to the safety requirements.

The aim of the present invention is to provide an interlock mechanism for the closing door of washing machines and the like that overcomes the limitations and drawbacks of the prior art and in particular provides not only mechanical prevention of starting of the machine with the door open, by effecting, during the operating phase of the machine and in the case of forced opening of the door, opening of the operating circuit with consequent stopping of the operating cycle, but also to recognize if blocking of the closing device occurred incorrectly, without insertion of the door catch.

According to the invention, these aims are achieved by means of a closing-door interlock mechanism according to Claim 1. Further advantageous characteristics form the object of the dependent claims.

The interlock mechanism according to the invention envisages, in fact, that the door interlock is provided with two contacts that make it possible to check, independently, whether the device is in the position with the door closed and locked (called locked-door contact) and whether the door catch is not inserted in the device (open-door contact).

The invention will now be described referring to the appended drawings illustrating a preferred but non-limiting embodiment of the invention, in which.

Figure 1:
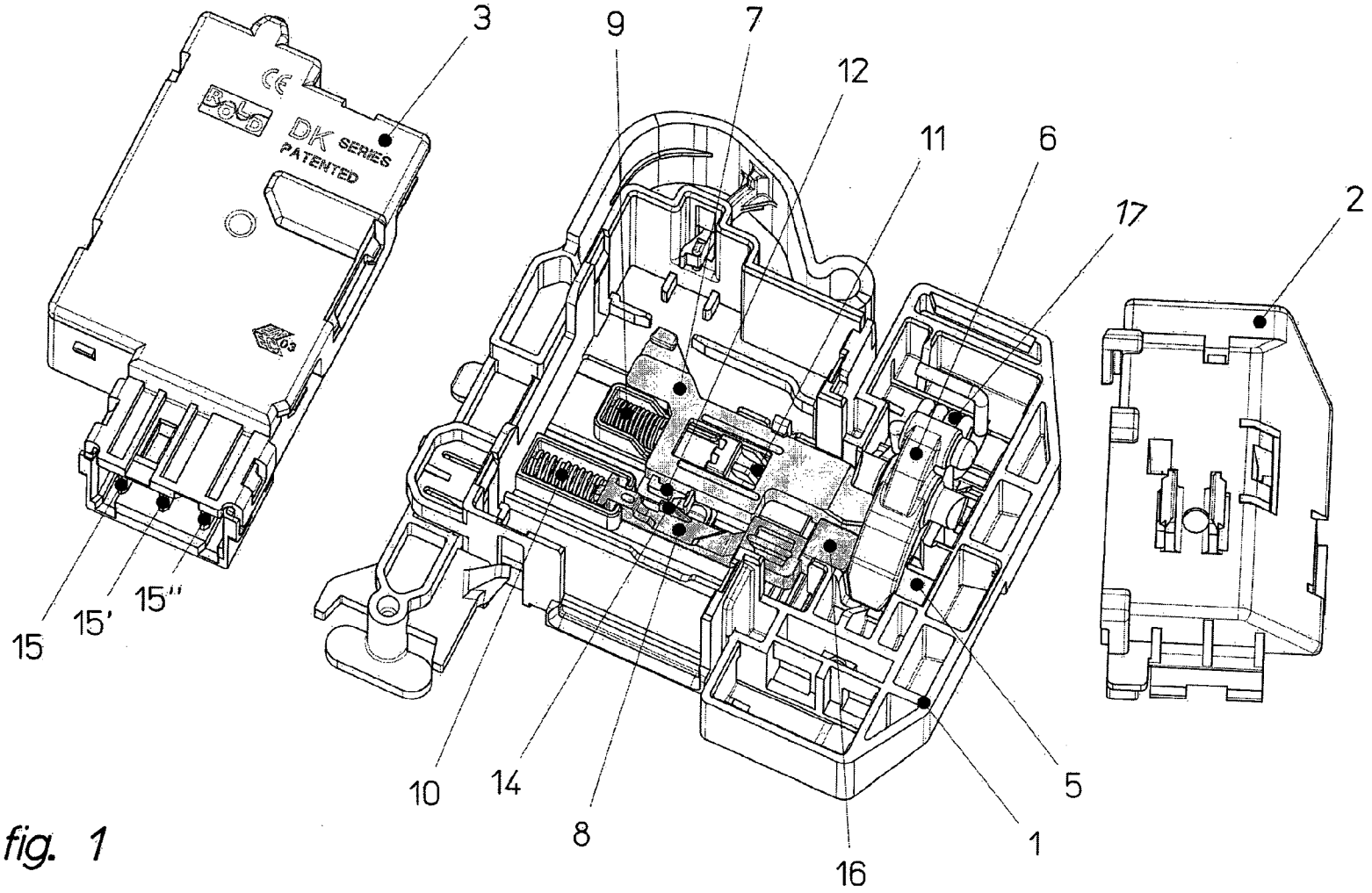
FIG. 1 is a partially exploded axonometric view, illustrating the door interlock mechanism according to the invention, in the "door open" position.
Figure 2:
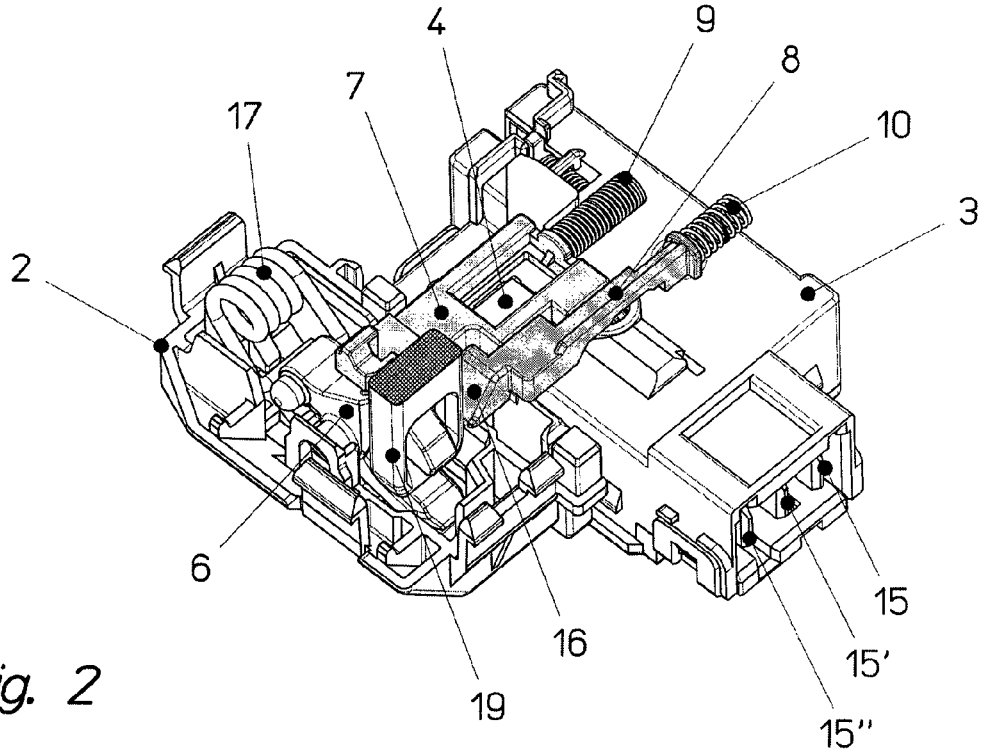
FIG. 2 is a view from below of the device according to the invention, without the support, in the "door closed" position.

Referring to FIGS. 1 and 2, the device according to the invention is formed from a support or containing body (1), preferably of thermoplastic material, which comprises, in a known way, a portion for fixing to the panel of the washing machine, closed by a cover (2), and a portion for housing a door interlock (3).

The door interlock or delaying device (3) is an electromechanical device, provided in a known manner with a latch (4) actuated by a thermal system, for example by the plate of the moving contact of a microswitch mounted in series on one phase of the machine operating current.

The door interlock (3) is provided with three terminals that extend to the outside in the form of quick-coupling contacts (15, 15', 15").

One of the contacts (15), called the locked-door contact, has the function of detecting whether the device is in the "door closed" position and locked, and is actuated by the solenoid simultaneously with the interlock latch (4).

Figure 3:
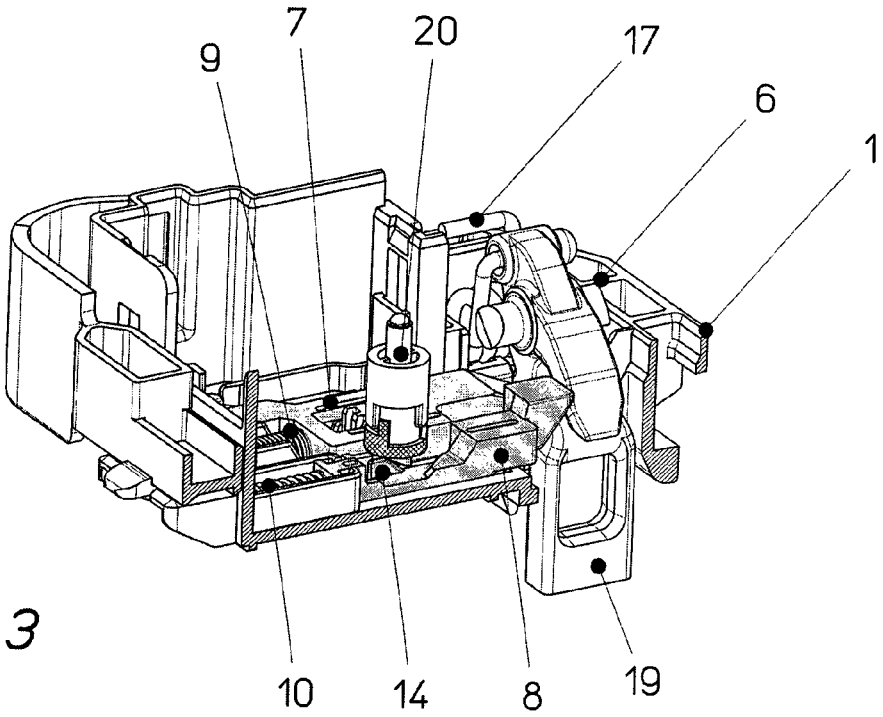
FIGS. 3 and 4 show a detail of the device, respectively with the door open and in the "door closed" position with the catch inserted.
Figure 4:
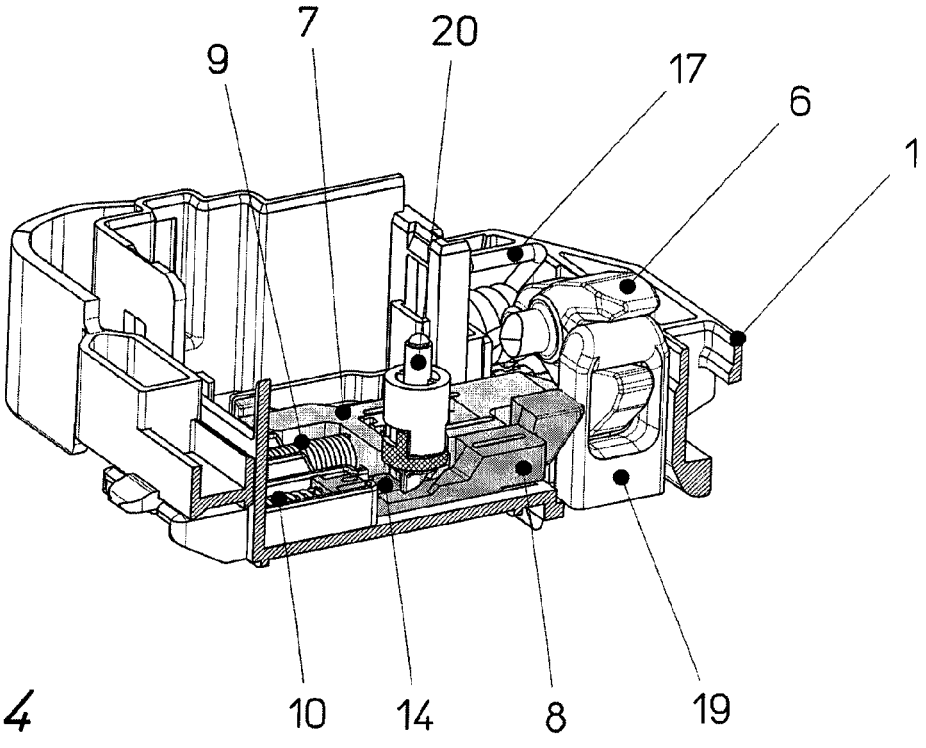

A second contact, called the open-door contact, since it has the function of detecting whether the door catch (19) is inserted in the device, is actuated by an actuator (20), shown in FIGS. 3 and 4.

The support (1) is provided with a rectangular opening (5) that receives the door catch (19) when the latter is closed.

The mechanical device for locking the door catch (19) consists of a catch or interlock wheel (6), able to rotate to correspond to opening (3) and subject to the action of a torsional spring (17).

Two sliders (7) and (8) are housed in support (1) and, subject respectively to the action of coil springs (9) and (10), engage the interlock wheel (6) with the shaped ends (13) and (16).

The first slider (7), in the central position, is provided with a window (11), for receiving the interlock latch (4) of the electromechanical delaying device (3), and has a shaped notch (12) for actuation of the actuator (20).

The second slider (8) carries, corresponding to notch (12) of the first slider (7), a shaped notch (14) for actuation of the actuator (20).

The operation of the device according to the invention is as follows.

With the door open, the parts that make up the device are in the relative positions illustrated in FIGS. 1 and 3.

The sliders (7) and (8), subject to the action of springs (9) and (10), are, with ends (13) and (16), up against the interlock wheel (6), which is arranged with the concavity facing the opening (5) so that it can receive the door catch (19).

In this position, as shown in the detail in FIG. 3, the second slider (8), with notch (14), acts on the actuator (20), keeping the open-door contact open.

The offset of window (11) of the first slider (7) relative to the interlock latch (4) obstructs the travel of the latter and so, even on supplying current to the machine, the operating circuit cannot be closed and the locked-door contact is open.

As shown in FIGS. 2 and 4, on closing the door, catch (19), inserted in opening (5), causes rotation of the interlock wheel (6) to the closing position and, simultaneously, acts upon the shaped end (16) of the second slider (8), which moves to oppose the action of spring (10). In this position notch (14) releases actuator (20) and permits its actuation by the first slider (7).

Said slider (7), under the action of spring (9), is pushed to the retaining position of wheel (6) and is positioned with window (11) on the same axis as latch (4) of the door interlock (3), while notch (12) actuates the actuator (20) and closes the locked-door contact.

On switching on the machine, the door interlock is supplied with current and trips latch (4) which enters window (11) of the first slider (7), locking it in the retaining position of the door catch (19), i.e. obstructing the rotation of the interlock wheel (6) to the opening position for the entire duration of these conditions.

In normal conditions, at the end of the operating cycle, in a known manner, interlock latch (4) moves back, releasing the first slider (7). On withdrawing catch (19) from the opening (5) for effecting opening of the door, under the action of spring (17), the interlock wheel (6) rotates, bringing back the parts of the device to the respective positions shown in FIGS. 1 and 3. The open-door contact and the locked-door contact return to the opening position.

In the case when, accidentally, during the operating cycle, the door catch (19) becomes detached from opening (5), for example as a result of yielding of catch (19) or of the striking zone or through incorrect dimensioning thereof, the second slider (8), under the action of spring (10), would move and with notch (14) would act upon the actuator (20) opening the door-open contact and permitting the electronics of the machine to detect the abnormal situation and to act upon the machine operating circuit.

Moreover, in the case when interlocking of the closing device occurs incorrectly, actuating wheel (6) for locking the door catch (19) in the retaining position, for example by means of a pointed object that simulates the action of the catch (19), the second slider (8), under the action of spring (10), would act with notch (14) on the actuator (20) keeping the door-open contact open and enabling the electronics of the machine, once again, to detect the abnormal situation and to act accordingly upon the machine operating circuit.

The invention has been illustrated with reference to preferred designs, but it is in general amenable to other applications and modifications that are intended to be included in the scope of protection, as will be obvious to a person skilled in the art.

The invention claimed is:

1. A door interlock device for washing machines or tumble dryers, the door interlock device comprising an interlock wheel of a door catch, a first slider able to lock the interlock wheel through interacting with elastic means, an electromechanical delaying device able to lock said first slider in a retaining position of the interlock wheel, a first contact member actuated by the electromechanical delaying device, and a second contact member actuated in a closing position by a shaped portion of said first slider when the door catch is locked, and actuated in an opening position by a shaped portion of a second slider which, interacting with the elastic means, interacts with the door catch and opens the second contact member when the door catch is not inserted or is disengaged.

2. The device according to claim 1, wherein the second contact member is actuated by an actuator, which is acted upon by the shaped portion of the first slider and by the shaped portion of the second slider.

3. The device according to claim 1, wherein the first slider has a shaped end that interacts with the interlock wheel.

4. The device according to claim 1, wherein the second slider has a shaped end that interacts with the interlock wheel and the door catch.

5. The device according to claim 1, wherein the interlock wheel of the door catch is subject to the action of torsional elastic means.

6. The device according to claim 1, wherein the first slider is provided with a window for receiving, in the retaining position of interlock wheel, an interlock latch of the electromechanical delaying device.

7. The device according to claim 6, wherein the interlock latch of the electromechanical delaying device is actuated a microswitch mounted in series on one phase of machine operating current.

* * * * *